US006057032A

United States Patent [19]

Green

[11] Patent Number: 6,057,032

[45] **Date of Patent: *May 2, 2000**

[54] YARNS SUITABLE FOR DURABLE LIGHT SHADE COTTON/NYLON CLOTHING FABRICS CONTAINING CARBON DOPED ANTISTATIC FIBERS

[76] Inventor: James R. Green, 22 Robin Dr., Hockessin, Del. 19707

[ * ] Notice: This patent is subject to a terminal disclaimer.

[21] Appl. No.: 08/948,359

[22] Filed: Oct. 10, 1997

[51] Int. Cl.[7] ..... B32B 3/00

[52] U.S. Cl. ..... 428/359; 428/362; 428/364; 428/373; 428/374; 428/301

[58] Field of Search ..... 428/359, 362, 428/364, 373, 374; 442/301

[56] References Cited

U.S. PATENT DOCUMENTS

| | | |
|---|---|---|
| 2,845,962 | 8/1958 | Bulgin . |
| 2,949,134 | 8/1960 | Hindle et al. . |
| 3,067,779 | 12/1962 | Draper et al. . |
| 3,803,453 | 4/1974 | Hull . |
| 3,969,559 | 7/1976 | Boe . |
| 3,971,202 | 7/1976 | Windley . |
| 3,987,613 | 10/1976 | Woods et al. . |
| 4,048,371 | 9/1977 | Brumlik . |
| 4,061,811 | 12/1977 | Takase et al. . |
| 4,154,881 | 5/1979 | Hirakawa et al. . |
| 4,207,376 | 6/1980 | Nagayasu et al. . |
| 4,216,264 | 8/1980 | Naruse et al. . |
| 4,232,082 | 11/1980 | Noritake . |
| 4,248,934 | 2/1981 | Wandel et al. . |
| 4,255,487 | 3/1981 | Sanders . |
| 4,296,597 | 10/1981 | Tani et al. . |
| 4,343,334 | 8/1982 | Sculze et al. . |
| 4,388,370 | 6/1983 | Ellis et al. . |
| 4,420,529 | 12/1983 | Westhead . |
| 4,422,483 | 12/1983 | Zins . |
| 4,473,617 | 9/1984 | van Leeuwen et al. . |
| 4,557,968 | 12/1985 | Thornton et al. . |
| 4,606,968 | 8/1986 | Thornton et al. . |
| 4,610,905 | 9/1986 | von Blucher . |
| 4,610,925 | 9/1986 | Bond . |
| 4,756,969 | 7/1988 | Takeda . |
| 4,771,596 | 9/1988 | Klein . |
| 4,781,223 | 11/1988 | McAliley et al. . |
| 4,813,459 | 3/1989 | Breidegam . |
| 4,856,299 | 8/1989 | Bryant . |
| 4,868,041 | 9/1989 | Yamagishi et al. . |
| 4,869,951 | 9/1989 | McCulough, Jr. et al. . |
| 4,927,698 | 5/1990 | Jaco et al. . |
| 4,950,533 | 8/1990 | McCullough, Jr. et al. . |
| 5,102,727 | 4/1992 | Pittman et al. . |
| 5,103,504 | 4/1992 | Dordevic . |
| 5,167,264 | 12/1992 | Kalin . |
| 5,277,855 | 1/1994 | Blackmon et al. . |
| 5,288,544 | 2/1994 | Mallen et al. . |
| 5,305,593 | 4/1994 | Rodini et al. . |
| 5,478,154 | 12/1995 | Pappas et al. . |
| 5,482,763 | 1/1996 | Shaffer . |
| 5,512,355 | 4/1996 | Fuson . |
| 5,617,904 | 4/1997 | Kalin . |

FOREIGN PATENT DOCUMENTS

| | | |
|---|---|---|
| 00557024A | 8/1993 | European Pat. Off. . |
| 8-296172 | 10/1996 | Japan . |

*Primary Examiner*—Richard Weisberger
*Attorney, Agent, or Firm*—Terry M Gernstein

[57] ABSTRACT

Yarns which are suitable for use in the warp of durable cotton/nylon clothing fabrics dyed in light shades with permanent antistatic properties are disclosed.

7 Claims, No Drawings

YARNS SUITABLE FOR DURABLE LIGHT SHADE COTTON/NYLON CLOTHING FABRICS CONTAINING CARBON DOPED ANTISTATIC FIBERS

TECHNICAL FIELD

This invention relates in general to yarns, and more particularly to yarns suitable for the warp of durable cotton/nylon clothing fabrics with permanent antistatic properties which can be dyed in light shades using cotton specific dyes despite the presence of black antistatic fibers. The fabrics are made from blends of cotton, nylon and sheath/core thermoplastic fibers doped with carbon particles.

BACKGROUND

While 100% cotton fabrics provide excellent resistance to nuisance static created by friction rubbing at relative humidities above 45%, they generate considerable electric shocks when rubbed below 35% relative humidity. Fabrics made from blends of cotton and nylon have better durability than cotton fabrics but have antistatic properties as poor as 100% cotton fabrics at low relative humidity. It is known that nuisance static can be reduced to acceptable levels in fabrics by adding at least 2% by weight of fabric of fibers uniformly doped with carbon black. However, light colored fabrics cannot be produced by this method because of the streaks caused by the black antistatic fibers.

The use of bundles of continuous thermoplastic filaments containing a delustered sheath completely surrounding a carbon doped core of less than 10% by volume of the fiber is known to provide antistatic protection without streaks in light colored carpets or in continuous filament clothing in concentrations as low as 0.05% by weight. Similar single staple filaments blended with other staple fibers are known to provide antistatic protection in carpets with as little as 0.5% by weight of carpet.

In order for nylon and antistatic fibers to be intimately blended and spun into yarns with cotton, the nylon fibers and antistatic fibers must be cut into short length staple rather than used as continuous filaments. Since the yarn sizes commonly used in clothing are much smaller than those used in carpets, the linear density of the antistatic fibers must be much smaller, i.e. not exceed 6 decitex, in order to be able to provide antistatic protection at very low concentrations. This causes several problems not anticipated in the prior art. While fibers significantly larger than 6 decitex having a carbon doped core of less than 10%, e.g 4%, by volume have a gray color, fibers no greater than 6 decitex of this type are black because the sheath is no longer of sufficent thickness to hide the black core. Conductivity per unit length of fiber decreases as fiber diameter gets smaller and is further reduced with each break in continuity, such as occurs with fibers cut to the short length i.e less than 6.3 cm, needed to be spinnable on the cotton system or when fine yarns are stressed by wear or laundering. A higher weight percent of antistatic fibers are needed as yarn size decreases to achieve the same level of conductivity per length of yarn. This need for a higher weight percent of fibers along with a change to a black color more than offsets the smaller filament diameter, and can result in streaks in light colored antistatic clothing fabrics containing small sheath/core conductive fibers.

Conductive carbonaceous fibers small enough to be processible with textile fibers such as cotton are known to provide antistatic protection with a little as 0.09% by weight of fabric even if only placed in the warp. However, these fibers are large, at least 7 microns in diameter, and are therefore readily visible in light colored fabrics. Also, since carbonaceous fibers are produced by oxidation of organic fibers, they are brittle and become weaker as fiber size is reduced whereas carbon doped sheath/core thermoplastic fibers become stronger as the core becomes smaller.

It would be highly desirable to be able to use conductive sheath/core thermoplastic fibers in cotton/nylon blend fabrics in light shade clothing because the antistatic properties provided in this manner are permanent and do not wear out.

OBJECTS OF THE INVENTION

It is a main object of the present invention to provide a yarn which is suitable for use in a durable cotton/nylon fabric dyed in light shades and which has permanent antistatic properties and is suitable for use in clothing.

It is another object of the present invention to provide a yarn that is suitable for use in a durable cotton/nylon fabric dyed in light shades and which has permanent antistatic properties and which has nylon fibers and antistatic fibers with short lengths.

It is another object of the present invention to provide a yarn that is suitable for use in durable cotton/nylon fabric dyed in light shades and which has permanent antistatic properties and which can use sheath/core thermoplastic fibers containing a conductive core doped with carbon.

It is a specific object of the present invention to provide a yarn that is suitable for use in durable cotton/nylon fabric dyed in light shades and which has permanent antistatic properties and which has sheath/core antistatic thermoplastic fibers with a linear density equal to or less than 6 decitex and contain a round carbon doped core no greater than 5 microns in diameter.

SUMMARY OF THE INVENTION

This invention provides these and other objects by providing yarns suitable for the warp of durable clothing fabrics having good antistatic properties at low relative humidity and uniform appearance when dyed in light shades. Such warp yarns are 20 to 80 tex and are comprised of 65 to 90% cotton fibers by weight, 10% to 35% nylon staple fibers, wherein antistatic fiber content is such that if the antistatic fibers lay end to end within the yarn at least 20% of the yarn length would contain sheath/core thermoplastic antistatic staple fibers having a linear density of no more than 6 decitex, containing a round core of the same polymer or a different polymer 1 to 5 microns in diameter, doped with conductive carbon black and no section of yarn would contain more than a single filament of such antistatic fibers. Novel fabrics are also provided comprised of warp and fill yarns containing no more than 0.40% by weight of fabric of the sheath/core thermoplastic antistatic fibers described herein, 65 to 95% cotton fibers and 5 to 35% nylon fibers by weight of fabric.

DETAILED DESCRIPTION OF THE INVENTION

The nylon staple fibers used herein without a carbon doped core are textile fibers having a linear density suitable for wearing apparel, i.e., less than 10 decitex per fiber, preferably less than 5 decitex per fiber. Still more preferred are nylon fibers that have a linear density of 1 to 3 decitex per fiber and length from 1.9 to 6.3 cm (0.75 to 2.5 in). It is essential that the antistatic fibers with a carbon doped core have a linear density no greater than 6 decitex in order to be to be able to provide antistatic protection at very low concentrations in yarns small enough for clothing.

When fibers are intimately blended there is a random distribution of fibers within the yarn bundles such that some sections of yarn may contain more antistatic fibers than others. Depending upon the amount of antistatic fibers, some sections of yarn may contain more than one antistatic fiber and others may contain none. If the antistatic fibers are black, it is easy to see streaks where there is more than one fiber within a section of yarn. Because the distribution is random, there will always be sections with more than one antistatic fiber. However, the sections of yarn containing more than one antistatic fiber can be reduced to an acceptable level by putting no more antistatic fiber in the yarns than would provide only one fiber in each section of yarn if the fibers were not randomly distributed but lay end to end along the length of the yarn. This is the maximum yarn length that can contain antistatic fibers. If there is more than enough antistatic fibers to fill the yarn length, then more length will contain two or more antistatic fibers and the fabric will have an unacceptable level of streaks.

For any given amount of antistatic fibers, the maximum percent of yarn length that can contain antistatic fibers $L_a$ occurs for the situation where the fibers lay end to end and can be calculated from:

$L_a$=yarn size in decitex x yarn weight % antistatic fiber/antistatic fiber size in decitex $L_a$=100 corresponds to having only one antistatic fiber in all sections of yarn.

If the linear density of the antistatic fibers exceeds 6 decitex there will be significant lengths of yarn which contain no antistatic fibers when the yarns are as small as commonly used for clothing (20 to 80 tex). For example yarns of 20 tex with 0.50% by weight of antistatic fibers have antistatic fibers within only 7% of their length if the antistatic fibers have a linear density of 15 decitex and 30% with antistatic fibers if the antistatic fiber size is reduced to 3.3 decitex. Since 20% is about the minimum amount of fiber length with antistatic fibers that be can tolerated, fabrics with 20 tex warp yarns containing 0.50% by weight of thermoplastic carbon doped fibers are antistatic if these antistatic fibers are 3.3 decitex and are not antistatic if the carbon doped fibers are 15 decitex even though the fabrics contain the same weight percent of antistatic fiber.

While it is important to know the minimum amount of antistatic fiber which will not cause streaks, it is also important to know the maximum in clothing fabrics because allowance must be made for a loss in antistatic protection due to breaks in the carbon core when garments are worn and laundered. This is especially important for cotton/nylon fabrics which are much more durable than 100% cotton. Experiments have shown that the maximum amount of black fibers in the warp or fill, that will not cause streaks is 0.40% by weight of fabric, respectively, in light shade clothing fabrics.

With fabrics having yarns in the range of 20 to 80 tex, the maximum amount of antistatic fibers in the fabric which will not cause streaks is limited by both the absolute amount of fiber (no more than 0.40% by weight of fabric in either the warp or fill) and the need to avoid having more than one carbon doped filament on average in any section of yarn. For example, if 75 tex warp yarns comprised 65% by weight of a fabric and contained 0.61% of antistatic fiber by weight of yarn, the warp yarns would not exceed their maximum limit of 0.0% antistatic fibers by weight of fabric. However, if the antistatic fibers were 3.3 decitex, they could fill 38% of the warp yarn length with more than one antistatic filament so such a fabric would be streaky. With 0.44% by weight of yarn of 3.3 decitex antistatic fibers in 75 tex yarns used as a warp there would be enough antistatic fibers to have only one fiber in each section of the yarn if the antistatic fibers lay end to end, so 0.44% by weight of yarn and 0.29% by weight of fabric is the maximum concentration for this size yarn in this type of fabric.

If the warp yarn size is too small i.e, less than 20 tex, even single 6 decitex antistatic filaments will become visible because antistatic fibers in adjacent yarns will come close enough to be seen as a double. With large yarns i.e., greater than 80 tex, such as for industrial fabrics or carpets, two or three adjacent filaments in the same yarn can be hidden within the relatively large yarns compared with the filaments and there is a wide separation between filaments in adjacent yarns, but these materials are not the subject of this invention. For purposes of this invention, the yarn size is the total linear density of the yarn and the yarns can be single or plied. A warp yarn made from two plies of 15 tex yarn is considered to fall within the scope of this invention because the total linear density is 30 tex. Fill yarn size is less critical because antistatic fibers are not required in the fill when warp yarns of this invention are used and streaks caused by fill yarns are usually visible only on the inside of garments if the fill yarns contain no more than 0.40% antistatic fibers.

The core size cannot exceed 5 microns in diameter or the antistatic fibers will create streaks in light colored fabrics in concentrations needed to provide antistatic protection. Cores less than 1 micron in diameter are too readily broken and have poor wash and wear durability.

Crimped fibers are particularly good for textile aesthetics and processibility.

Nylon is required instead of other reinforcement fibers such as polyester because its unusually high toughness allows the small (10% to 35% in the warp) quantities necessary for this invention to provide a substantial improvement in abrasion resistance. As shown in Table 1, U.S. Pat. No. 4,920,000, (the disclosure of which is included herein for reference) 20% polyester in the warp of cotton blend fabrics only increases the abrasion resistance 50% compared with 100% cotton fabrics, whereas 30% nylon triples the abrasion resistance. Nylon 6,6 is the preferred aliphatic polyamide but others such as 6 nylon may be used. The nylon must be present in the warp but not necessarily the fill in order to improve abrasion resistance and no more than 35% can be present in the fabric in order to limit the amount of antistatic fiber required to that which will not cause streaks.

Conductive sheath/core thermoplastic fibers have crush resistance superior to metallic fibers and better strength than thermoset fibers made from degraded polymers or thermoplastic fibers in which the carbon is uniformly dispersed. Wear life is superior to fibers which have carbon only on the fiber surface and while the black round internal segments of sheath/core fibers becomes visible at 6 decitex linear density, the black core can be reduced to 1 to 5 microns in diameter without weakening the filament.

An exemplary antistatic fiber for use in the present invention is that made by doping a polyethylene core with carbon particles and surrounding it with a sheath of nylon such as that made with a linear density of 3.3 decitex, a core size of about 3 microns and a length of 3.8 cm (1.5 in) by the Dupont Co. and commercially available in blends with 98/2% T420 nylon/P140 antistatic staple fibers. Other carbon doped fibers may be used, provided that filaments have a linear density no greater than 6 decitex and contain round segments of the same polymer or a different polymer 1 to 5 microns in diameter doped with electrically conductive carbon black. The technology for making such sheath/core fibers is described in U.S. Pat. No. 3,803,453, U.S. Pat. No. 4,207,376, and U.S. Pat. No. 4,756,969, the disclosures of which are incorporated herein for reference.

The same dyes used on non antistatic cotton/nylon fabrics, e.g. vat, direct and naphthol dyes may be used even though these dyes are specifically for cotton and only the cotton is dyed and not the nylon and nylon sheath of the carbon doped fibers. This permits fabrics to achieve a greater range of colors and washfastness than would be the case if the antistatic fibers had to be hidden by dyeing the cotton, the nylon and nylon sheathed fibers.

Greige fabric construction as described herein refers to the condition of the fabric on or off the loom in an unfinished state. Generally such fabrics contain chemical size applied to the warp such as starch, as an aid to weaving. Yarn weights and fabric weights as described herein refer to the yarn and fabric weights without the chemical size. Greige fabrics which have been rinsed and cleaned in preparation for dyeing are referred to as bleached.

The process for making the fabric involves the step of first preparing a blend comprising 65% to 90% cotton fibers, 10% to 35% aliphatic polyamide (nylon) staple fibers by weight and sufficient antistatic thermoplastic fibers to fill 20 to 100% of the length of yarns of 20 to 80 tex with single filaments if they lay end to end within the yarns, having a linear density of no more than 6 decitex, containing round segments of the same polymer or a different polymer 1 to 5 microns in diameter doped with electrically conductive carbon black. Yarn is spun from the blend and fabric is woven using these yarns as the warp with no more than 0.40% by weight of fabric of the antistatic fibers in the warp and fill yarns comprised of no more than 0.40% by weight of fabric of such antistatic fibers, 50 to 100% cotton fibers and 0 to 50% nylon fibers by weight of yarn.

It is important to maintain the proper content and location of the three fiber types to achieve the desired results. If there is enough carbon doped fibers in the warp to fill the entire length of the warp with more than one carbon doped fiber if they lay end to end, streaks will be produced in light colored fabrics and if less than 20% of yarn length contains antistatic fibers if they lay end to end, there will be a loss of antistatic protection. If the fabric contains more than 35% nylon fibers in the warp, more than 0.40% by weight of fabric of antistatic fibers will be required in the warp which will cause streaks, too little will result in no improvement in wear life compared with 100% cotton fabrics. The fill must contain no more than 0.40% by weight of fabric of antistatic fibers in order to not produce streaks in the fill direction. At least 10% nylon by weight of yarn must be present in the warp in order to improve abrasion resistance and up to 50% nylon can be used in the fill. More nylon can be tolerated in the fill than the warp because the warp yarns of this invention are capable of dissipating the charge provided that there is no more than 35% nylon in the fabric.

Problems that occur as yarn sizes become as small as those required in clothing fabrics and when fabrics contain highly insulative fibers such as nylon, have been overcome with this invention such that fabrics containing carbon doped sheath/core thermoplastic fibers at a level not visible in light colored fabrics can provide antistatic protection.

As shown in Examples 1,2 and Table 1 below, antistatic protection was achieved in cotton/nylon blend fabrics with 0.26,0.24% by weight of fabric, respectively, of carbon doped thermoplastic fibers in the fabric. As shown in Table 1, comparative fabrics A,B which are similar to Examples 1,2 respectively, except for the absence of carbon doped fibers, exhibited high charge build up as measured by static cling. Comparative Example C was similar to Example 2 except that it was made of 100% cotton and contained no antistatic fibers. Cling Time of Example C was greater than 360 sec. which illustrates the ability of 100% cotton fabrics to hold a strong charge for a long time at low relative humidity.

The percent of warp length containing carbon doped fibers in Examples 1,2 was 44% and 68% respectively, while 118% was calculated for comparative Examples D and E corresponding to having more than one filament in 18% of the yarn length. The warp yarns in Examples D and E also contained more than 0.40% antistatic fiber by weight of fabric. When Example 1 was dyed a light khaki color using direct dyes it was very uniform and had no objectionable streaks. When Example 2 was dyed to a light khaki color using direct and vat dyes, respectively, it had a highly uniform appearance with no objectionable streaks. When Examples D,E were dyed a light khaki shade with direct dye, numerous objectionable streaks due to the antistatic fibers were obtained. Example E failed the Cling Test even though the fabric had more than the maximum of 0.40% antistatic fibers by weight of fabric in the warp that should not be exceeded to avoid streaks, which illustrates the importance of having no more than 35% nylon in the warp.

During processing of the fabrics of the invention durable press resins may be applied to the fabric. Many other conventional fabric treatments may also be carried out on the fabrics such as flame retarding, mercerization, application of dyes, hand builders and softeners and framing.

The antistatic fabrics described in this invention can be flame retarded by methods such as are disclosed in the following patents, the disclosure of which are incorporated herein for reference. However, these patents do not disclose how to make antistatic light colored fabrics. U.S. Pat. No. 5,480,458, and U.S. Pat. No. 5,468,545 describe nylon/cotton blend fabrics treated with a flame retardant which lasts the life of the garment. U.S. Pat. No. 4,909,805 describes a two step process for applying flame retardant to blends of cotton and nylon fibers. This and other flame-retardant treatment technology such as Patent U.S. Pat, No. 5,571,288 and flame-retardants containing antimony can be applied to antistatic yarns and fabrics of this invention without losing the antistatic protection.

NFPA 1991-9.29 Material Static Charge Accumulation Resistance Test

This test devised by the National Fire Protection Association (NFPA) involves rubbing samples with a rotating wheel and measuring the residual voltage 5 seconds after the wheel is stopped. Tests are conducted in a chamber with a controlled relative humidity. Those skilled in the art are familiar with the documentation associated with NFPA 1991-9.29; therefore these documents will not be discussed in detail here but such documentation is incorporated herein by reference.

Static Cling Test

All measurements are preceded by washing fabrics with hot water and detergent with no softener in a home laundry machine and drying in a conventional tumble drier in preparation for testing. This is repeated three times. Fabric samples at least 20×20 cm in size are then dried for twenty minutes on a hot plate of the same size with an insulative surface at 65 deg. C. (150 deg. F.) to reduce the moisture to less than 2%, similar to the moisture level in fabrics at less than 35% relative humidity. Fabrics are rubbed 20 times across the warp with a 100% polyester cloth over an area of 15×15 cm (6×6)" while on the hot plate. Immediately (less than 5 sec.) after the fabric is removed from the hot plate three polystyrene pith balls are placed at least 3 cm. apart on the rubbed area with the fabric held in a vertical position in a room with an ambient temperature between 15 to 27 deg. C. (60 to 80 deg. F.), and 45% to 65% relative humidity. The length of time in seconds until all three pith balls fall from the fabric is called the Cling Time.

Fabrics which hold the pith balls less than 60 seconds have very low nuisance static at relative humidities below 35% whereas those which hold the balls 120 sec. or more will cause electrical shocks in garments worn below 35% relative humidity. Samples with a Cling Time of less than 60 seconds are considered to have passed the Cling Test, and can be expected to produce barely noticeable shocks at low humidity. Those greater than 120 seconds have failed and can be expected to produce significant electrical shocks. Samples with a Cling Time between 60 and 120 seconds are borderline and may produce small shocks at very low humidity.

EXAMPLE 1

A 3×1 left hand twill greige fabric was made having in the warp 75% cotton fibers, 24.5 wt % of polyhexamethylene adipamide (6,6 nylon) fibers having a linear density of 2.77 dtex (2.5 dpf) and a length of 3.8 cm (1.5 in) and 0.5% by weight of yarn of fibers with a linear density of 3.3 decitex and a length of 3.8 cm (1.5 in) comprised of a 3 micron diameter round polyethylene core containing conductive carbon particles, surrounded with a sheath of nylon, (available as 98% T-420 nylon/2% P140 antistatic fiber blend from Dupont).

Since the warp yarn linear density was 29 tex (20 l/cc) a maximum of 44% of yarn length contained antistatic fibers. The fill was made from 100% cotton yarns with a linear density of 47 tex (12.7 l/cc). The fabric had a nylon content of 12.74%, cotton content was 87% and antistatic fiber of 0.26% by weight of fabric. The fabric in the greige condition had 84 warp ends and 46 ends in the fill. After the fabric was bleached and washed it had a basis weight of 220 gm/m2 and Cling Time of 40 seconds. When the fabric was dyed a light khaki color with direct dyes it was very uniform and had no objectionable streaks. After dyeing and washing three times, the residual voltage after 5 sec. measured by NFPA 1991-9.29 at 20% relative humidity was about 3,000 volts compared with about 20,000 volts for 100% cotton and similar cotton/nylon fabrics which did not contain antistatic fibers.

Comparative examples A not of the invention and described in Table 1 was made similar to Example 1 but the fabric contained no antistatic fiber and was bleached and dyed. Cling Time was greater than 360 seconds.

EXAMPLE 2

A 4×1 sateen greige fabric was made having in the warp 75% cotton fibers, 24.5 wt % of polyhexamethylene adipamide (6,6 nylon) fibers having a linear density of 2.77 dtex (2.5 dpf) and a length of 3.8 cm (1.5 in) and 0.5% of fibers by weight of yarn with a linear density of 3.3 decitex and a length of 3.8 cm (1.5 in) comprised of a 3 micron diameter round polyethylene core containing conductive carbon particles, surrounded with a sheath of nylon, (available as 98% T-420 nylon/2% P140 antistatic fiber blend from Dupont). Since the warp yarn linear density was 45 tex (13 l/cc), 68% of yarn length contained antistatic fibers. The fill was made from 100% cotton yarns with a linear density of 59 tex (10 l/cc). The fabric had a nylon content of 11.76%, cotton content of 88% and antistatic fiber of 0.24% by weight of fabric. The fabric in the greige condition had 75 warp ends and 62 ends in the fill. After the fabric was bleached it had a basis weight of 301 gm/m2 and the Cling Time was 40 seconds. After dyeing a light khaki color with direct and vat dyes, respectively, the fabric exhibited no objectionable streaks due to the presence of the carbon doped fibers.

Comparative example B not of the invention and described in Table 1 was made similar to Example 2 but the fabric contained no antistatic fiber and was bleached, dyed and flame retarded. Cling Time was 360 seconds. Comparative Example C not of the invention was similar to Example 2 and B except that it was made of 100% cotton yarns in the warp and fill and contained no antistatic fibers. It had a Cling Time of greater than 360 seconds.

Comparative Example D was made as a 2×1 left hand twill with 39 tex (15 l/cc) yarns comprised of 49% nylon, 1% carbon doped thermoplastic antistatic fibers described in Examples 1,2 from Dupont and 50% cotton in both the warp and fill with 81×56 ends x picks in the greige state. About 18% of warp yarn length contained more than one antistatic fiber on average. After the fabric was bleached and laundered the basis weight was 254 gm/m2 and the Cling Time was about 10 seconds. Objectionable streaks due to the antistatic fibers were seen in both the warp and fill direction after dyeing a light khaki color with direct dye.

Comparative Example E was made as a 2×1 left hand twill with 39 tex (15 l/cc) 49% nylon, 1% by weight of yarn carbon doped thermoplastic fibers described in Examples 1,2 and 50% cotton fibers in the warp and the fill was 45 tex (13 l/cc) 100% cotton yarns. There were 81×44 ends×picks in the greige state. About 18% of the warp length contained more than one antistatic fiber on average. The greige fabric contained 69/30.38/0.62% cotton/nylon/antistatic fiber by weight of fabric. Objectionable streaks were seen in the warp direction after the fabric was laundered and dyed a light khaki color with direct dye. Basis weight after dyeing was 264 g/m2 and Cling Time was 150 seconds.

TABLE 1

ANTISTATIC CLING TEST RESULTS

| EXAMPLE | CLING TIME OF PITH BALL SEC. | ANTISTATIC |
|---|---|---|
| 1. 3 × 1 TWILL 75/24.50/.50% COTTON/NYLON/ CARBON DOPED FIBER IN THE WARP 100% COTTON FILL 0.26% ANTISTATIC FIBER 3 MICRON DIA. CORE 29,47 TEX WARP, FILL BASIS WEIGHT 220 GM/M2 | 40 | PASS |
| A) LIKE 1 BUT DYED 0.0% ANTISTATIC FIBER. | GREATER THAN 360 | FAIL |
| 2. 4 × 1 SATEEN 75/24.50/.50% COTTON/NYLON/ CARBON DOPED FIBER IN THE WARP 100% COTTON FILL 0.24% ANTISTATIC FIBER 3 MICRON DIA. CORE 45,59 TEX WARP, FILL | 40 | PASS |

TABLE 1-continued

ANTISTATIC CLING TEST RESULTS

| EXAMPLE | CLING TIME OF PITH BALL SEC. | ANTISTATIC |
|---|---|---|
| BASIS WEIGHT 301 GM/M2 | | |
| B) LIKE EX. 2 BUT DYED AND FR TREATED 0.0% ANTISTATIC FIBER | 360 | FAIL |
| C) LIKE EX. 2 BUT DYED AND FR TREATED, 100% COTTON, 0.0% ANTISTATIC FIBER. | GREATER THAN 360 | FAIL |
| D) 2 × 1 TWILL FABRIC 50/49/1% COTTON/ NYLON/CARBON DOPED FIBER IN THE WARP AND FILL 1% ANTISTATIC FIBER 3 MICRON DIA. CORE 39 TEX, WARP AND FILL BASIS WEIGHT 254 GM/M2 | 10 | PASS |
| E) 2 × 1 TWILL FABRIC 50/49/1 COTTON/ NYLON/CARBON DOPED FIBER IN THE WARP 100% COTTON FILL .62% ANTISTATIC FIBER 3 MICRON DIA. CORE 39,45 TEX WARP, FILL BASIS WEIGHT 264 GM/M2 | 150 | FAIL |

Although the present invention has been described in detail with respect to certain preferred embodiments thereof and the best mode known to the inventor, it is understood that those skilled in the art will be able to envision variations thereof based on the teaching of this disclosure. It is intended that such variations are within the scope of this disclosure as well.

I claim:

1. A woven antistatic fabric (suitable for durable clothing with light shade colors,) comprising: 65% to 95% cotton fibers and 5% to 35% nylon staple fibers by weight of fabric, and no more than 0.40% sheath/core antistatic thermoplastic staple fibers by weight of fabric in either the warp or fill having a linear density of no more than 6 decitex containing a round core of a polymer 1 to 5 microns in diameter doped with electrically conductive carbon black, warp yarns with a linear density of 20 to 80 tex comprised of 65% to 90% cotton fibers and 10% to 35% nylon staple fibers by weight of yarn and sufficient sheath/core antistatic staple fibers to fill 20% to 100% of the warp yarn length with single antistatic fibers (calculated assuming the antistatic fibers lay end to end) wherein the sheath/core thermoplastic fibers have a linear density no greater than 6 decitex and contain a round core of a polymer 1 to 5 microns in diameter, said sheath/core fibers being doped with conductive carbon black and including fill yarns comprised of no more than 0.40% by weight of fabric of such antistatic fiber, 50% to 100% cotton fibers and 0.0% to 50% nylon fibers by weight of yarn.

2. The woven fabric defined in claim 1 wherein each of the sheath/core antistatic fibers includes a round core of polyethylene doped with carbon surrounded by a nylon sheath.

3. The woven fabric defined in claim 1 wherein the warp is comprised of two yarns plied.

4. The woven fabric defined in claim 1 wherein the fill yarns are made from 100% cotton fibers.

5. The woven fabric defined in claim 1 including a flame-retardant treatment on the cotton fibers.

6. The woven fabric defined in claim 1 wherein the fill is comprised of two yarns plied.

7. The woven fabric defined in claim 1 wherein both the warp and the fill are comprised of two yarns plied.

* * * * *